US009226557B2

(12) United States Patent
Sullivan

(10) Patent No.: US 9,226,557 B2
(45) Date of Patent: Jan. 5, 2016

(54) BAG SYSTEM WITH A SMALL BAG INSERT AND METHOD OF MANUFACTURE AND USE THEREOF

(71) Applicant: Carol Jean Sullivan, Redington Beach, FL (US)

(72) Inventor: Carol Jean Sullivan, Redington Beach, FL (US)

( * ) Notice: Subject to any disclaimer, the term of this patent is extended or adjusted under 35 U.S.C. 154(b) by 0 days.

(21) Appl. No.: 14/457,198

(22) Filed: Aug. 12, 2014

(65) Prior Publication Data

US 2015/0041031 A1 Feb. 12, 2015

Related U.S. Application Data

(60) Provisional application No. 61/864,776, filed on Aug. 12, 2013.

(51) Int. Cl.

| | |
|---|---|
| ***A45C 3/06*** | (2006.01) |
| ***A45C 3/00*** | (2006.01) |
| ***A45C 13/02*** | (2006.01) |

(52) U.S. Cl.

CPC . *A45C 3/06* (2013.01); *A45C 3/001* (2013.01); *A45C 13/02* (2013.01); *A45C 2013/026* (2013.01); *Y10T 29/49826* (2015.01)

(58) Field of Classification Search

CPC ..... A45C 3/06; A45C 13/126; A45C 7/0045; Y10T 29/49826

USPC ..... 150/111, 113; 190/108.11; 29/428

See application file for complete search history.

(56) References Cited

U.S. PATENT DOCUMENTS

| | | | | |
|---|---|---|---|---|
| 2,899,999 | A * | 8/1959 | Dobbs et al. | 150/106 |
| 3,414,033 | A * | 12/1968 | Tucker | 150/104 |
| 4,754,790 | A * | 7/1988 | Meyers | 150/104 |
| 5,402,869 | A | 4/1995 | Saltzman et al. | |
| 5,829,502 | A | 11/1998 | Distefano et al. | |
| 6,446,688 | B1 | 9/2002 | Sutton | |
| 6,634,473 | B1 | 10/2003 | Wagner | |
| 6,968,880 | B2 | 11/2005 | Battaglia et al. | |
| 7,055,564 | B2 | 6/2006 | Carey et al. | |
| 7,293,635 | B2 | 11/2007 | Repke et al. | |
| 7,461,676 | B2 * | 12/2008 | Huie | 150/105 |
| 7,828,457 | B2 | 11/2010 | Davidoff et al. | |
| 8,251,113 | B2 * | 8/2012 | Baxter | 150/104 |
| 8,684,054 | B2 * | 4/2014 | Platt et al. | 150/105 |
| 2002/0121322 | A1 | 9/2002 | Seamon | |
| 2005/0173034 | A1 * | 8/2005 | Antrobus | 150/104 |
| 2006/0021684 | A1 * | 2/2006 | DeCoro, III | 150/105 |
| 2007/0089818 | A1 * | 4/2007 | Bigel | 150/113 |
| 2009/0084475 | A1 | 4/2009 | Dean-Perry | |
| 2009/0183806 | A1 * | 7/2009 | Foster et al. | 150/111 |
| 2011/0000590 | A1 * | 1/2011 | Welch et al. | 150/104 |
| 2014/0053960 | A1 * | 2/2014 | Johnson et al. | 150/113 |
| 2014/0182753 | A1 * | 7/2014 | Secretan | 150/103 |

* cited by examiner

*Primary Examiner* — Sue A Weaver

(74) *Attorney, Agent, or Firm* — Jeffrey Watson; Balser & Grell IP Law

(57) ABSTRACT

A bag system with a small bag insert includes a large bag and a small bag. The large bag has a cavity with an inner wall. The small bag is sized to fit inside the large bag. The small bag is removably attached approximate to a top half of the inner wall of the large bag via an attachment system.

16 Claims, 6 Drawing Sheets

BAG SYSTEM WITH A SMALL BAG INSERT AND METHOD OF MANUFACTURE AND USE THEREOF

CROSS-REFERENCE TO RELATED APPLICATIONS

To the full extent permitted by law, the present U.S. Non-provisional patent application hereby claims priority to and the full benefit of U.S. Non-provisional application entitled "Tote Bag With a Small Bag Insert," having assigned Ser. No. 61/864,776, filed on Aug. 12, 2013, incorporated herein by reference in its entirety.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The disclosure generally relates to handbags, tote bags, purses, clutches, cosmetic bags, etc., and namely to a bag system with a small bag insert.

2. Description of Related Art

The disclosure relates generally to handbags, tote bags, purses, clutches, cosmetic bags, etc. with a small bag insert, a method of using the same, and a method of manufacturing the same.

A tote bag, as used herein, may refer to a large and often unfastened bag, with parallel handles that emerge from the sides of its pouch. A standard tote may be made of sturdy cloth, perhaps with thick leather handles and/or bottoms. Common fabrics may include heavy canvas, possibly dyed, or treated to resist moisture and mold, jute, and in more recent times heavy nylon and other easy-care synthetics have become common. However, although the instant disclosure may be directed toward a tote bag, the invention is not so limited and other similar hand bags, purses, diaper bags, work bag, weekend bag, carry-on bag, travel bag, etc. or the like, can also be used and are thus considered a part of the instant disclosure.

In today's society, people are becoming increasingly busier and on the go constantly. Fashion conscious women (and possibly men) may therefore be in need of a fashionable bag that can meet the various demands of her (or his) day. In some instances, the person may require the space of a larger bag, like a tote for traveling, going to the gym, etc. In other instances, the person may desire a smaller bag and leave the bulky tote behind, like a purse, clutch, cosmetic bag, etc. for going to dinner, a night out on the town, etc. Thus, there is clearly a desire for two separate size bags that are fashionable and convenient to carry. However, in most cases, especially with people on the go, they may desire both the larger bag for space at certain times in the day and the smaller bag for ease and convenience for other times in the day. Typically, a person desiring both bags would be required to stack, balance, etc. the bags on one's shoulders or arms and lug around both bags.

In addition, the person would be required to transfer the essentials (wallet, makeup, etc.) from one bag to another depending on which one is being using at the time, which may waste time and may often lead to misplaced items. Another problem with this multiple bag setup is that these bags often do not match, which is highly undesirable for fashion conscious people.

Therefore, it is readily apparent that there is a recognizable unmet need for a bag system (like a tote bag or other similar bags, like a hand bag, purse, diaper bag, travel bag, work bag, weekend bag, carry-on bag, the like, etc.) with a small bag insert that is fashionable, convenient, and easy to operate. The instant disclosure is designed to address at least some of the above mentioned problems by providing a bag system with a small bag insert.

SUMMARY

Briefly described, in a preferred embodiment, the present apparatus and method overcomes the above-mentioned disadvantages and meets the recognized need for such a device by providing a bag system (tote bag or other similar bag, like a hand bag, purse, diaper bag, travel bag, work bag, weekend bag, carry-on bag, the like, etc.) with a small bag insert that is fashionable, convenient, and easy to operate.

The present apparatus and method includes a large bag with a small bag insert which may include a tote bag (or other similar bag, like a hand bag, purse, diaper bag, travel bag, work bag, weekend bag, carry-on bag, the like, etc.) and a small bag. The large bag may have a cavity with an inner wall. The small bag may be sized to fit inside the large bag. The small bag may be removably attached approximate to a top half of the inner wall of the large bag via an attachment system.

According to its major aspects and broadly stated, the present disclosure describes a bag system, the bag system having a large bag with a small bag insert configured therein, to be attached approximate to the top half of the inner wall of the large bag via an attachment system. The large bag may be a tote bag or any other desired large bag, like a hand bag, purse, diaper bag, travel bag, work bag, weekend bag, carry-on bag, the like, etc. The small bag insert may be any desired bag sized to fit inside of the large bag, including, but not limited to, a purse, wallet, clutch, cosmetic bag, tablet bag, the like, etc.

In one embodiment, the large bag and the small bag may match or coordinate.

One feature of the instant disclosure may be the attachment system, which could be turn locks, buttons, snaps, hook and loop type fasteners (like Velcro®), the like, or any combinations thereof.

In one embodiment, the attachment system may be one or more turn locks.

One embodiment of the turn lock attachment system may be that it can include a turn, or plurality of turns, and a base, or plurality of bases. Each of the turns may be attached to the inner wall of the large bag and may each have a rotatable protrusion. Each of the bases may be attached to the outside of the small bag and may each have a hole adapted to receive the corresponding rotatable protrusion. In this turn lock attachment system embodiment, when each of the rotatable protrusions may be inserted into the corresponding hole in the base, each of the rotatable protrusions may be rotated for securing the turns to the bases.

In one embodiment, the turn lock attachment system may have three turn locks.

One feature of the turn lock attachment system may be that the turns can be attached to the top half of the inner wall of the large bag and the bases may be attached approximate to the top of the small bag above the opening. With this feature, when the small bag may be secured in the large bag via the turn locks, the turn locks may position the small bag approximate to the top of the large bag.

In one embodiment, the bases may be positioned on one side of a top reinforced portion of the small bag above its opening.

One feature of the instant disclosure may be the inclusion of straps on the inner wall of the large bag. The straps may be for preventing the small bag from swinging or flapping inside the large bag. In one embodiment, the large bag may include two straps on the inner wall adapted for preventing the small bag from swinging or flapping inside the large bag.

One feature of the large bag may be that it can be a tote bag which can be a large and often unfastened bag with a pouch, and parallel handles emerging from the sides of the pouch.

One feature of the small bag may be that it can include a removable strap.

In use, a method of manufacturing a bag system with a small bag insert may generally include the following steps. A step of providing the large bag (tote bag or other similar bag, like a hand bag, purse, diaper bag, travel bag, work bag, weekend bag, carry-on bag, the like, etc.) having a cavity with an inner wall. A step of providing the small bag sized to fit inside the provided large bag. A step of installing the attachment means for removably attaching the small bag approximate to a top of the inner wall of the large bag. The attachment means may include one or more turns attached to the inner wall of the large bag and may each have a rotatable protrusion, and a corresponding number of turn bases being positioned to the outside of the small bag and each having a hole adapted to receive the corresponding rotatable protrusion. A step of inserting each of the rotatable protrusions into the corresponding hole in the base. And finally a step of rotating the protrusions thereby securing each of the turns to the bases.

One feature of the method of manufacturing the bag system with a small bag insert may be where the turns can be attached approximate to the top of the inner wall of the provided large bag and the bases can be positioned approximate to the top of the provided small bag above the opening, whereby, when the small bag may be secured in the large bag via the turn locks, the turn locks positioning the small bag approximate to the top of the large bag.

These and other features of the bag system with a small bag insert will become more apparent to one skilled in the art from the prior Summary, and following Brief Description of the Drawings, Detailed Description, and Claims when read in light of the accompanying Detailed Drawings.

BRIEF DESCRIPTION OF THE DRAWINGS

The present bag system with a small bag insert will be better understood by reading the Detailed Description with reference to the accompanying drawings, which are not necessarily drawn to scale, and in which like reference numerals denote similar structure and refer to like elements throughout, and in which.

Figure 1:
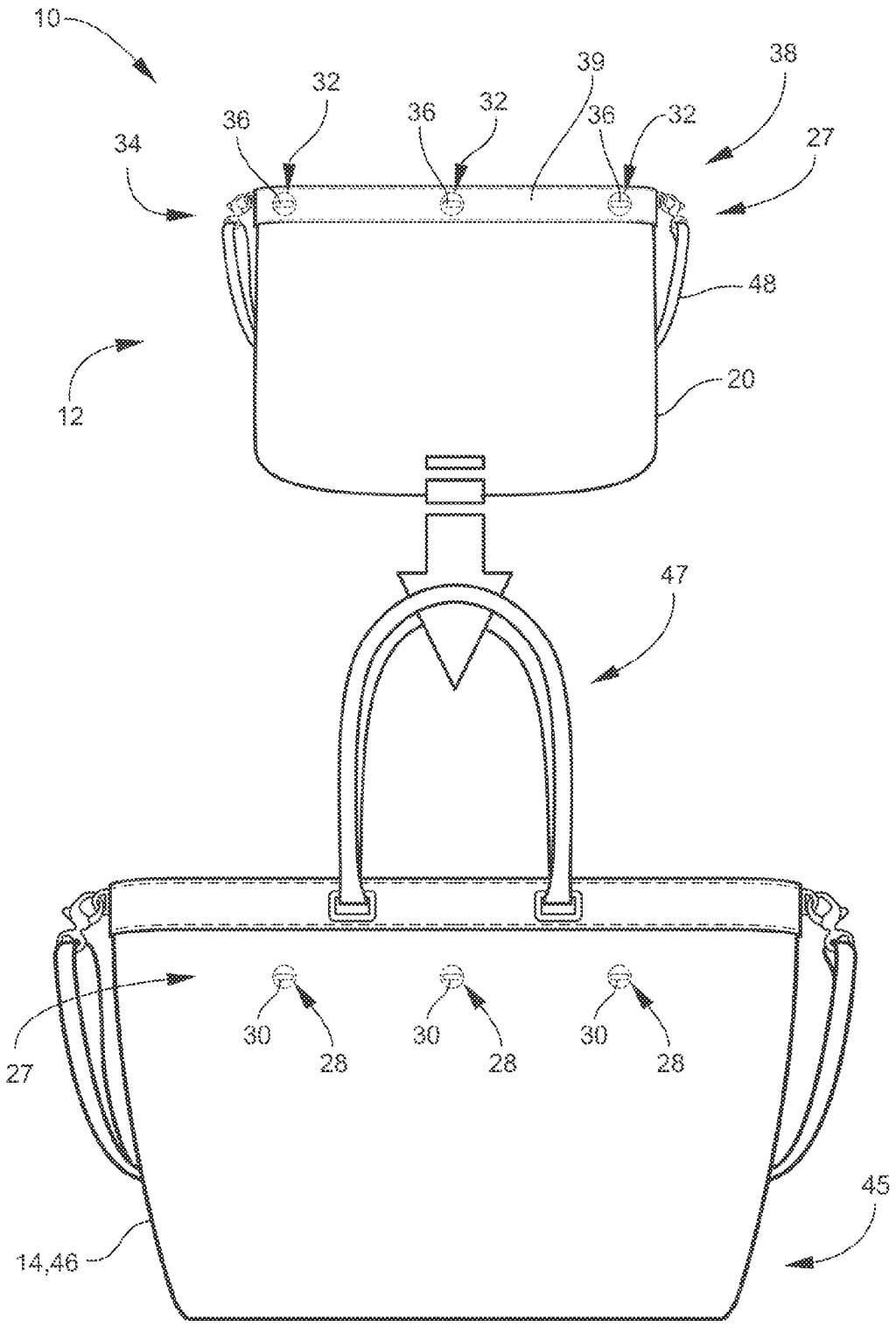
FIG. 1 is a side view of an exemplary embodiment of the bag system with the small bag insert outside of the large bag according to the instant disclosure.
Figure 2:
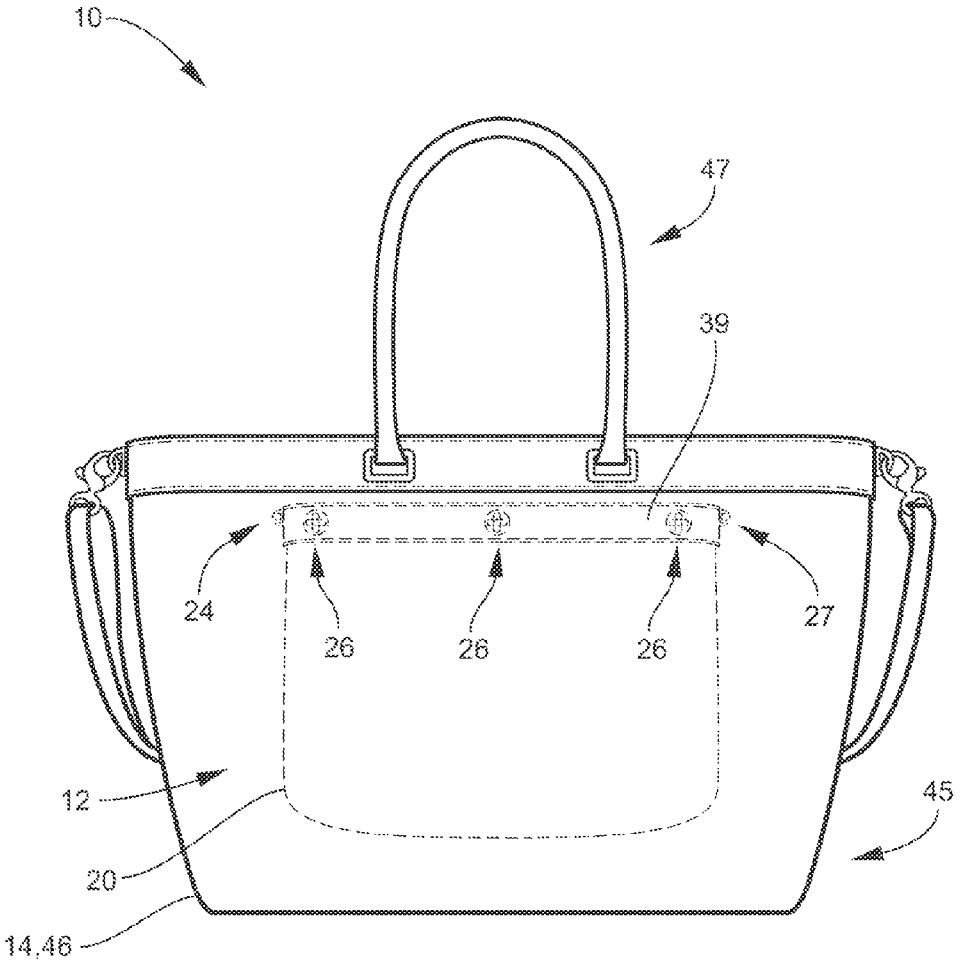
FIG. 2 is another side view of the exemplary embodiment from FIG. 1 with the small bag attached inside the large bag.
Figure 3:
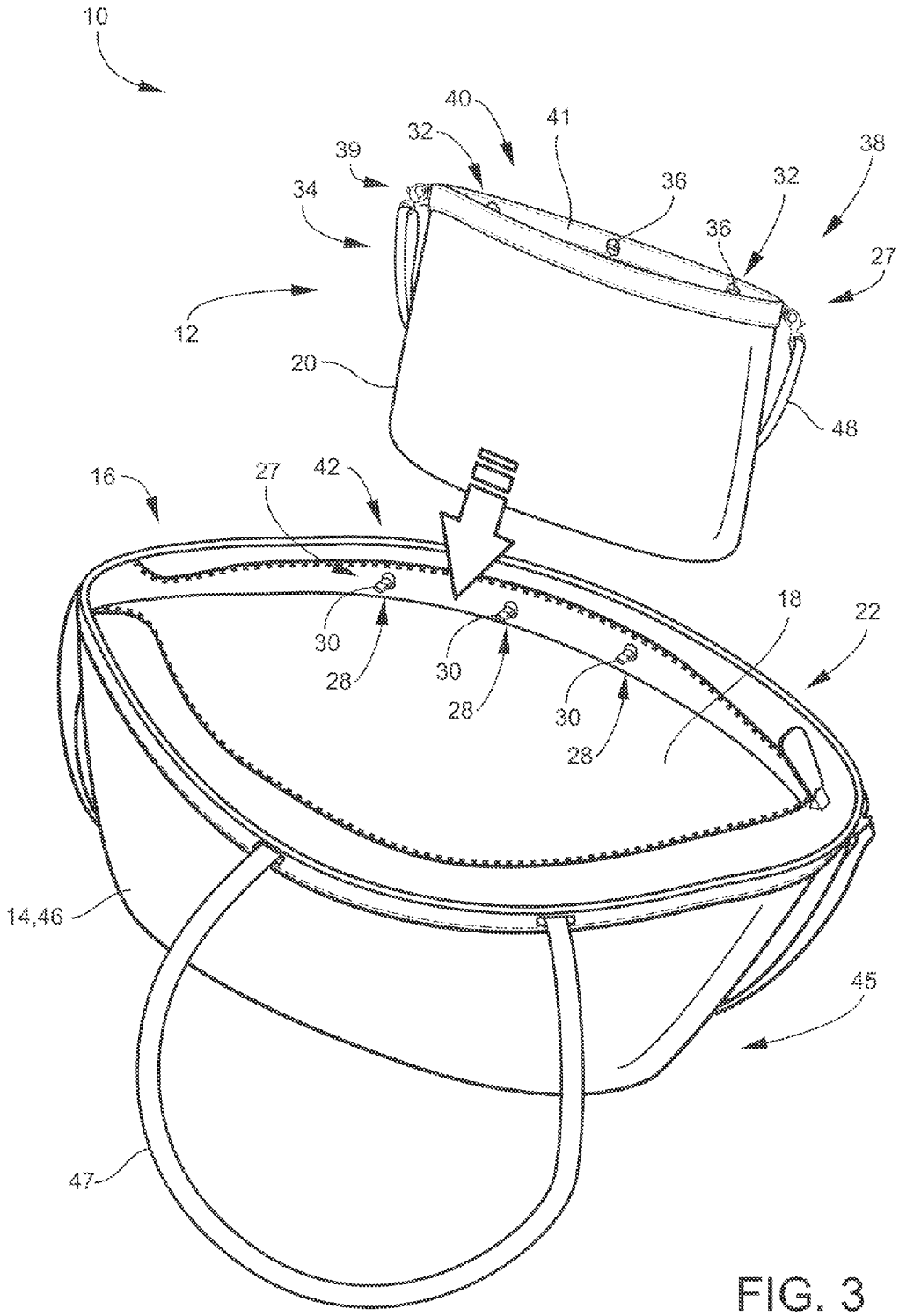
FIG. 3 is a top perspective view of another exemplary embodiment of the bag system with the small bag insert outside of the large bag according to the instant disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

In describing the exemplary embodiments of the present disclosure, as illustrated in FIGS. 1-6, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-5 by way of example, and not limitation, therein is illustrated an example embodiment bag system 10 with small bag insert 12, wherein bag system may generally include large bag 14 and small bag 20 sized to fit inside large bag 14. Large bag 14 may have cavity 16 with inner wall 18. Small bag 20 may be removably attached approximate to top half 22 of inner wall of large bag 14 via attachment system 24. In select optional embodiments, large bag 14 and said small bag 20 may match or coordinate.

Attachment system 24 may be included in bag system 10 for securing small bag 20 inside cavity 16 of large bag 14 to inner wall 18. Attachment system 24 may be any devices, means, or combination of devices or means for securing small bag 20 inside cavity 16 of large bag 14 to inner wall 18. For example, attachment system 24 may be turn locks 26, buttons, snaps, hook and loop type fasteners (like Velcro®), the like, and/or combinations thereof. In a possibly preferred embodiment, attachment system 24 may be one or more turn locks 26.

Turn locks 26 may be included in bag system 10 as the attachment system 24. Turn locks 26 may be for attaching small bag 20 inside cavity 16 of large bag 14 to inner wall 18 in an easy to operate, fast and convenient manner. Turn locks 26 may be any desired turn locks. In select embodiments, each turn lock 26 may include turn 28 and base 32. Each of turns 28 may be attached to inner wall 18 of large bag 14 and may each have rotatable protrusion 30. Each of the bases 32 may be positioned on outside 34 of small bag 20 and may each have hole 36. Each hole 36 may be adapted to receive the corresponding rotatable protrusion 30 of turns 28. Wherein, when each of rotatable protrusions 30 are inserted into the corresponding hole 36 in each base 32, each rotatable protrusion 30 may be rotated for securing each turn 28 to the corresponding base 32. In a reverse alternate embodiment, turns 28 may be attached to the top of small bag 20 and bases 32 may be positioned inside large bag 14.

Attachment system 24 may include any number of desired turn locks 26 for securing small bag 20 inside cavity 16 of large bag 14 to inner wall 18. In a possibly preferred embodiment, attachment system 24 may have three turn locks 26 in linear row 27. In this embodiment, the three turn locks 26 may be positioned in linear row 27 a set distance below the zipper of large bag 14, like a set distance of 0.75 inches below the zipper.

In one embodiment, attachment system 24 may secure small bag 20 inside cavity 16 of large bag 14 to inner wall 18 at top 38 of cavity 16. This may provide a desired position of small bag 20 in large bag 14 as it will be easy to attach and remove. In addition, this position of small bag 20 at top 42 of cavity 16 in large bag 14 may provide a user the desired easy access to small bag 20. In this embodiment, each turn 28 may be attached approximate to top 42 of cavity 16 of large bag 14 and each base 32 may be positioned approximate to top 38 of small bag 20 above its opening 40 (this will allow for small bag 20 to open even when attached inside large bag 14). Whereby, when small bag 20 may be secured in large bag 14 via turn locks 26, turn locks 26 may position small bag 20 approximate to top 42 of cavity 16 of large bag 14. In one embodiment, bases 32 may be positioned on one side 41 of top reinforced portion 39 of small bag 20 above its opening 40. This embodiment may provide holes 36 of bases 32 on the top of small bag insert 12, which may eliminate the need for holes on the inside of small bag insert 12. In another embodiment (not shown in the Figures), bases 32 may be positioned on both sides, (or even more for larger bags) of top reinforced portion 39 of small bag 20 above its opening 40. This embodiment may allow multiple small bag inserts 12 to be secured in large bag 14.

Attachment system 24 may allow a user to secure small bag insert 12 inside large bag 12. Attachment system 24 may be a standard attachment system throughout a line of bags of various sizes, shapes and/or colors. This may allow a user to interchange various small bag inserts 20 with various large bags 14. For example, a user may require a wallet or clutch one day as small bag insert 12 and a purse or tablet bag on another day or occasion. As such, all bags in bag system 10 may be interchangeable using attachment system 10. For example, with the turnlocks 26 embodiments shown in the Figures, each turnlock 26 may remain the same for every bag in bag system 10, with the same dimensions and spacing. As such, a user could carry a durable nylon tote as carry-on with a leopard print crossbody bag inside for your final destinations. Then a few days later trade the leopard print to your everyday handbag, i.e. all inserts will work in every large bag 14. As a result, each bag with bag system 10 can be mixed and matched according to the fashion and functional demands of the user's day.

Straps 44 may be included in select embodiments of large bag 14. Straps 44 may be on inner wall 18 of cavity 16 inside large bag 14. Straps 44 may be used for preventing small bag 20 from swinging or flapping inside large bag 14 while large bag 14 may be transported or carried. Straps 44 may be any desired shape, size or material adapted for preventing small bag 20 from swinging or flapping inside large bag 14. For example, straps 44 may be made from an elastic material or may include a fastener for tightening straps 44 around small bag 20. In one embodiment, large bag 14 may include two straps 44 on inner wall 18 that may be adapted for preventing small bag 20 from swinging or flapping inside large bag 14.

Large bag 14 may be any desired larger bag that can fit small bag 20 inside including, but not limited to tote bag 46, or other similar bags, like a hand bag, purse, diaper bag, travel bag, work bag, weekend bag, carry-on bag, the like, etc. Tote bag 46 may include a large and often unfastened bag with pouch 45, and handles, like parallel handles 47, emerging from the sides of pouch 45. In one embodiment, large bag 14 may include reinforced corners for added structure. In another embodiment, large bag 14 may have an external pocket. The external front pocket may be positioned approximately 3.5 inches from the top of large bag 14 and may have a width of approximately 7.5 inches and a height of approximately 1.25 inches. In yet another embodiment, large bag 14 may include external side pockets at both ends of large bag 14.

Small bag 20 may be any desired smaller bag that can fit inside large bag 14, including, but not limited to a purse, wallet, clutch, cosmetic bag, tablet bag, the like, etc. The shape of small bag 20 may be spacious in size but sleek enough to minimize the space used in large bag 14. The shape of small bag 20 may provide enough structure for support for handling when attached to large bag 14. In one embodiment, small bag 20 may include removable strap 48. Removable strap 48 may allow small bag 20 to be converted from a purse, to a wallet or clutch, or other similar conversions. In addition, removable strap 48 may or may not be desired to be removed when attached inside large bag as small bag insert 12. In another embodiment, small bag 20 may include over the edge zipper adapted to allow small bag 20 to open fully. This over the edge zipper may be convenient to access small bag 20, especially when attached inside large bag 14 as small bag insert 12.

Referring now to the specific embodiments shown in FIGS. 1-5, the instant disclosure may be directed toward tote bag 46 with small bag insert 12. Tote bag 46 can be any size or shaped bag, tote bag, hand bag, purse, travel bag, work bag, weekend bag, carry-on bag, the like, etc. Small bag insert 12 may be any type of bag that is sized smaller than tote bag 46 to fit inside tote bag 46, including, but not limited to, a purse, wallet, clutch, cosmetic bag, tablet bag, the like, etc. In one embodiment, tote bag 46 and small bag insert 12 may match, i.e. they may be made out of similar materials with similar designs. However, the invention is not so limited and other non-matching embodiments may be desired.

Small bag 20 may be adapted to attach to the inside of tote bag 46. Small bag 20 may attach to the inside of tote bag 46 by any means. For example, small bag 20 may be adapted to attach to inner wall 18 of tote bag 46. In one embodiment of this example, small bag 20 may be adapted to attach to inner wall 18 of tote bag 46 via attachment system 24. Attachment system 24 may be any device, system, or combination thereof, etc. adapted to attach small bag 20 to the inside of tote bag 46. As examples, attachment system 24 may include, but is not limited to: turn locks 26, buttons, snaps, hook and loop type fasteners (like Velcro®), the like, and combinations thereof.

In the embodiment shown in the Figures, attachment system 24 may be one or more turn locks 26. Each turn lock 26 may include turn 28 and a corresponding base 32. Each turn 28 may be attached to inner wall 18 of tote bag 46 and may have rotatable protrusion 30. Each base 32 may be positioned to outside 34 of small bag 20 and may have hole 36 adapted to receive the corresponding rotatable protrusion 30. When each rotatable protrusion 30 may be inserted into the corresponding hole 36 in each base 32, each rotatable protrusion 30 may be rotated to secure turns 28 to bases 32. In one embodiment, attachment system 24 may comprise three such turn locks 26.

Turns 28 may be positioned anywhere on the inside of tote bag 46, including, but not limited to, being attached approximate to top half 22 of inner wall 18 of tote bag 46. Bases 32 may be positioned anywhere on small insert bag 12, including, but not limited to, being positioned approximate to top 38 of small bag 20 above its opening 40. In one embodiment, when small bag 20 may be secured in tote bag 46 via turn locks 26, turn locks 26 may position small bag 20 approximate to top 42 of tote bag 46. This may allow small bag 20 to act as a pocket inside of tote bag 46, which is very convenient to access near the top 42 of tote bag 46. In one embodiment, bases 32 may be positioned on the top inch of small bag 20.

Tote bag 46 may include any additional features for helping secure small insert bag 12 inside. For example, tote bag 46 may include one or more straps 44 on inner wall 18 which may be adapted for preventing small bag 20 from swinging or flapping inside tote bag 46. In one embodiment, tote bag 46 may include two such straps 44.

Tote bag 46 may be any design, shape, or size bag, tote bag, purse, etc. and the like. Tote bag 46 may include: a large and often unfastened bag with a pouch 45; and handles, like parallel handles 47, emerging from the sides of pouch 45. In one embodiment, tote bag 46 may have a width of approximately 20.5 inches, a height of approximately 13.5 inches, and parallel handles 47 may have a height of approximately 10.5 inches. Tote bag 46 may be made of any material, including, but not limited to, a sturdy cloth. The sturdy cloth may be any sturdy cloth including, but not limited to, heavy canvas, possibly dyed, or treated to resist moisture and mold, jute, heavy nylon and other easy-care synthetics, etc., the like, and combinations thereof. Examples of synthetic materials which may be used in select embodiments include polyurethane (PU), poly vinyl chloride (PVC), polyester, nylon, satin etc. PU and PVC may be designed to be faux leather materials. In one embodiment, tote bag 46 may include thick leather handles and/or bottoms.

Small insert bag 12 may be any design, shape, or size bag, purse, clutch, wallet, cosmetic bag, tablet bag, etc. and the like. In one embodiment, small insert bag 12 may include removable strap 48. Removable strap 48 may be adapted to be taken off when inserted into tote bag 46. In another embodiment, small insert bag 12 may include an over the edge zipper adapted to allow small bag 20 to open fully. When inserted into tote bag 46, this over the edge zipper feature may allow small insert bag 12 to open fully providing a large and accessible pocket inside tote bag 46.

Figure 4:
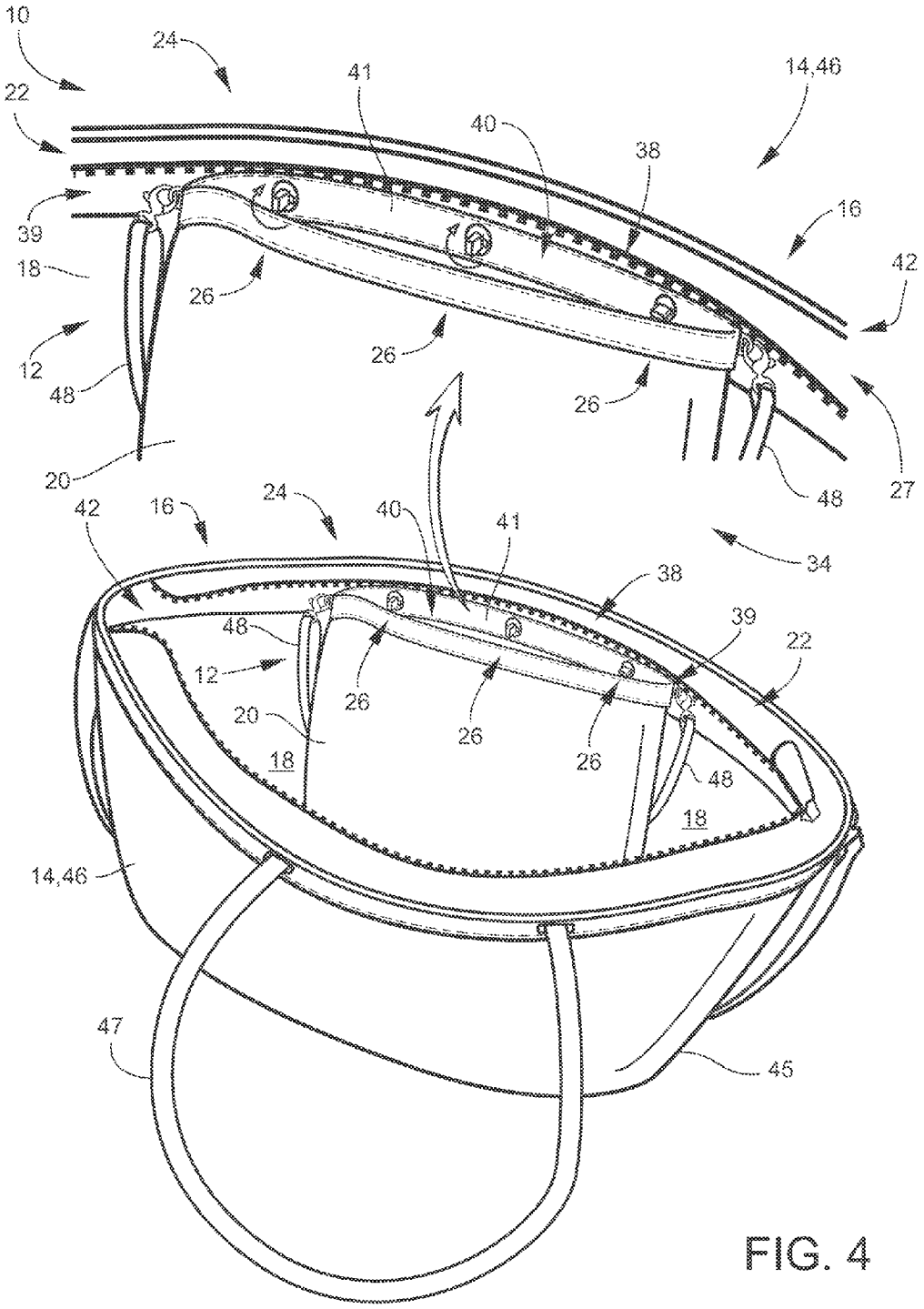
FIG. 4 is a top perspective view of another exemplary embodiment of the bag system with the small bag insert inside of the large bag according to the instant disclosure with a zoomed in partial view.
Figure 5:
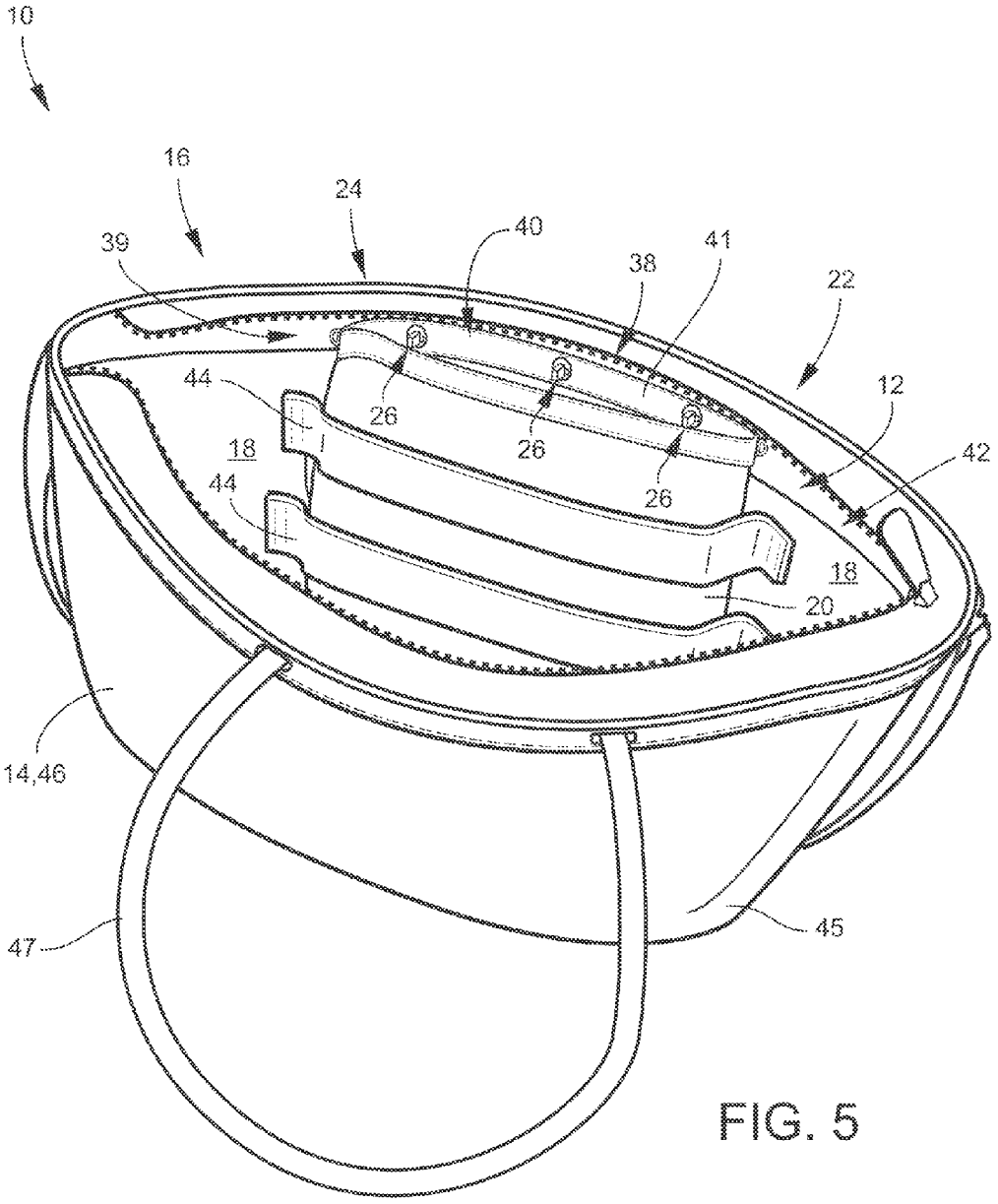
FIG. 5 is a top perspective view of another exemplary embodiment of the bag system with the small bag insert inside of the large bag according to the instant disclosure.

As shown in FIG. 4, to remove small bag insert 12 from large bag 14, turn rotatable protrusions 30 to unlock turn locks 26. If removable strap 48 was removed, then removable strap 48 may be re-attached. Since small bag 20 may be used as a large pocket of large bag 14, the user's essentials may already be inside small bag insert 12.

For users, including, but not limited to the fashion-conscious woman who lives a busy life and is constantly on the go, the instant disclosure of a tote bag 46 (or other similar large bag 14) with a small bag insert 12 may provide many advantages and uses, including, but not limited to, the following list: a user can effortlessly meet the various demands of the day; a user can downsize with the small bag for convenience or upgrade to the tote for more space; a user can go to work with a tote then to lunch with a purse, leaving the bulky tote behind; a user can go to the gym with the tote and then to dinner with a purse; a user can travel with a carry on and then go sight see with a purse; a user can eliminate excess baggage and stay organized throughout the day; a user doesn't have to stack and balance multiple bags on their shoulder; a user can easily access the purse at the top of the tote instead of fishing for it at the bottom; a user can keep her essentials in the purse whether the user is downgrading or upgrading in size; a user can seamlessly stay fashionable; a user no longer has to carry mix match bags; a user can stay coordinated whether the user downgrades or upgrades in size; a user can save time and money; since the users essentials can stay in the purse even when attached to the tote, the user doesn't have to waste time exchanging and misplacing items; a user gets two bags for the price of one with strategic use of affordable materials and streamlined ownership and production; allows a user to interchange various large bags and small bags with the same bag system; everyday handbag becomes "pocket" of tote when you need a larger bag; all essential items, such as keys, wallet, phone, are instantly in place inside the larger bag or tote; all essential items are easily accessible at the top of your large bag or tote; consolidate two bags into one; handbag is securely and safely located inside your large bag or tote; the like; etc., and combinations thereof.

Figure 6:
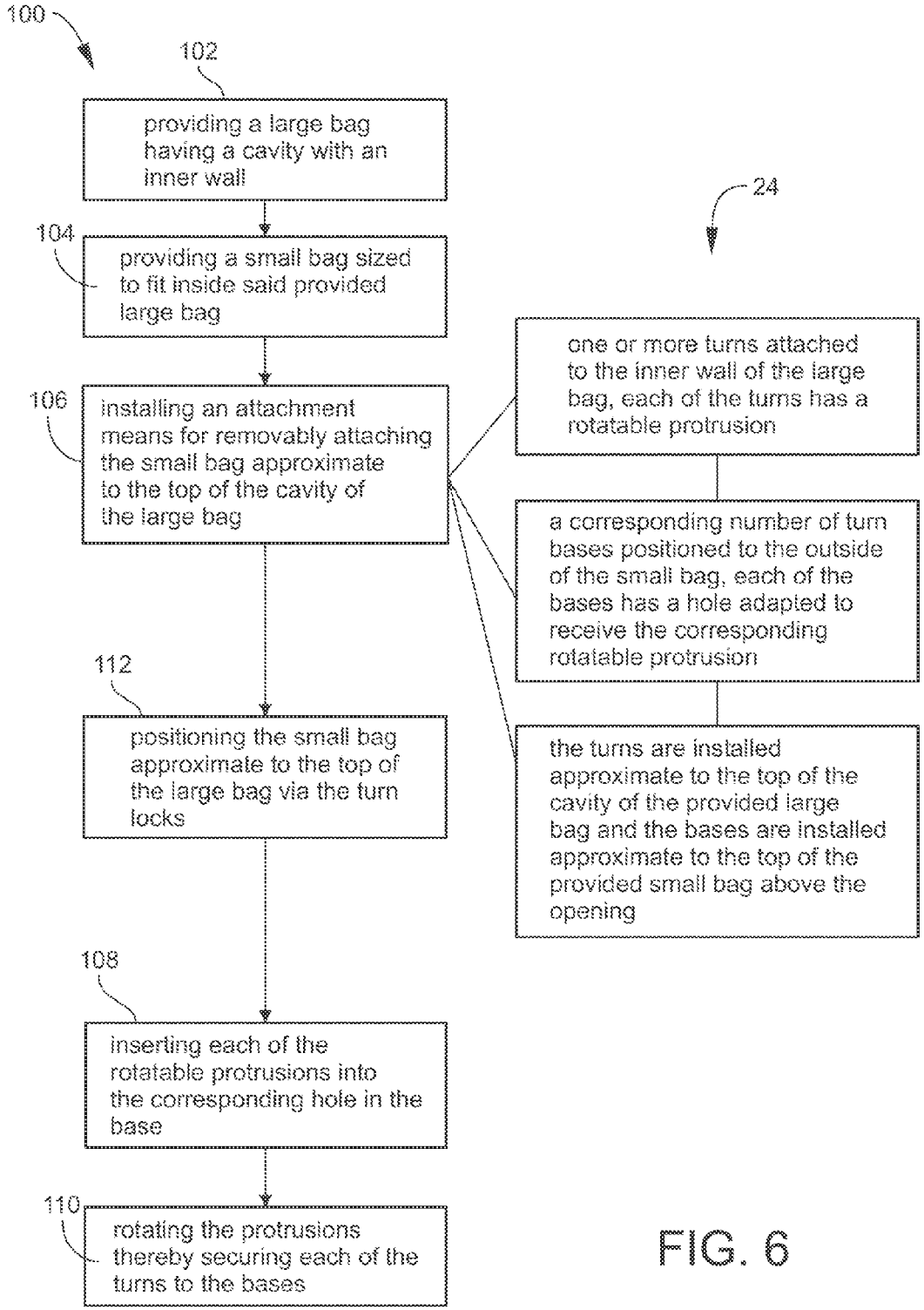
FIG. 6 is a flow chart depicting an exemplary method of manufacturing the bag system with the small bag insert according to an exemplary embodiment of the instant disclosure.

Referring now to FIG. 6, the instant disclosure also includes method 100 of manufacturing bag system 10 with small bag insert 12 in any of the embodiments shown or described herein. Method 100 may generally include, but is clearly not limited hereto, the following steps. Step 102 of providing large bag 14 in any of the various embodiments shown or described herein, including having cavity 16 with inner wall 18. Step 104 of providing small bag 20 in any of the various embodiments shown or described herein, including being sized to fit inside said provided large bag 14. Step 106 of installing attachment means 24 in any of the various embodiments shown or described herein for removably attaching small bag 20 approximate to top 46 of inner wall 18 of large bag 14, where attachment means 24 may include: one or more turns 28 which may be attached to inner wall 18 of large bag 14 and each may have rotatable protrusion 30; a corresponding number of turn bases 32 which may be positioned to outside 34 of small bag 20 and may each have hole 36 adapted to receive the corresponding rotatable protrusion 30. Step 108 of inserting each of rotatable protrusions 30 into the corresponding hole 36 in each base 32. And a step 110 of rotating each rotatable protrusion 30 thereby securing each of turns 28 to each base 32.

In one embodiment of method 100 of manufacturing bag system 10 with small bag insert 12, where turns 28 may be installed or attached approximate to top 42 of inner wall 18 of the provided large bag 14 and bases 3 may be installed and positioned approximate to top 38 of the provided small bag 20 above opening 40, and where small bag 20 may be secured in large bag 14 via turn locks 26, step 112 may be included of positioning small bag 20 approximate to top 42 of large bag 14 via turn locks 26.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A bag system with a small bag insert comprises:
a large bag having a cavity with an inner wall; and
a small bag sized to fit inside said large bag;
said small bag is removably attached approximate to a top half of the inner wall of said large bag via an attachment system, said attachment system being turn locks comprising:
a turn attached directly to the inner wall of said large bag, said turn has a rotatable protrusion; and
a base positioned to the outside of said small bag and, said base has a hole adapted to receive said rotatable protrusion;
wherein, when said rotatable protrusion is inserted into said hole in said base, said rotatable protrusion is rotatable to secure said turn to said base;
wherein, said large bag includes straps directly on the inner wall for preventing said small bag from swinging or flapping inside said large bag.

2. The bag system with a small bag insert of claim 1 wherein said large bag and said small bag match.

3. The bag system with a small bag insert of claim 1 wherein said attachment system has three turn locks in a linear row.

4. The bag system with a small bag insert of claim 1 wherein said turns are attached approximate to the top of the cavity of said large bag and said bases are positioned approximate to the top of said small bag above an opening;
whereby, when said small bag is secured in said large bag via said turn locks, said turn locks position said small bag approximate to the top of said cavity of said large bag.

5. The bag system with a small bag insert of claim 4 wherein said bases are positioned on one side of a top reinforced portion of said small bag above said opening.

6. The bag system with a small bag insert of claim 1 wherein said large bag includes two straps directly on the inner wall adapted for preventing said small bag from swinging or flapping inside said large bag.

7. The bag system with a small bag insert of claim 1 wherein said large bag being a tote bag, said tote bag comprises:
a large and often unfastened bag with a pouch; and
parallel handles emerging from each side of said pouch.

8. The bag system with a small bag insert of claim 1 wherein said small bag includes a removable strap.

9. The bag system with a small bag insert of claim 1 wherein said attachment system allowing:
a plurality of said small bag inserts to be interchangeable with said large bag;
a plurality of said large bags to be interchangeable with said small bag insert; or
combinations thereof.

10. The bag system with a small bag insert of claim 9 wherein said attachment system being a plurality of said turn locks, wherein each of said turnlocks have the same size and spacing for each of said plurality of small bag inserts, each of said plurality of large bags, or combinations thereof.

11. A tote bag with a small bag insert comprises:
a cavity with an inner wall; and
a small bag sized to fit inside said tote bag;
said small bag being removably attached approximate to a top half of the inner wall of said tote bag via an attachment system being one or more turn locks;
wherein each of said turn locks comprises:
a turn attached directly to the inner wall of said tote bag, said turn has a rotatable protrusion; and
a base positioned to the outside of said small bag, said base has a hole adapted to receive said rotatable protrusion;
wherein, when said rotatable protrusion being inserted into said hole in said base, said rotatable protrusion is rotatable to secure said turn to said base;
wherein, said tote bag includes straps directly on the inner wall for preventing said small bag from swinging or flapping inside said large bag.

12. The tote bag with a small bag insert of claim 11 wherein said attachment system having three turn locks in a linear row.

13. The tote bag with a small bag insert of claim 11 wherein said turns are attached approximate to the top of the cavity of said tote bag and said bases are positioned approximate to the top of said small bag above an opening;
whereby, when said small bag is secured in said tote bag via said turn locks, said turn locks position said small bag approximate to the top of said tote bag.

14. The tote bag with a small bag insert of claim 13 wherein said bases are positioned on one side of a top reinforced portion of said small bag above said opening.

15. A method of manufacturing a bag system with a small bag insert comprises the steps of:
providing a large bag having a cavity with an inner wall with straps directly on the inner wall;
providing a small bag sized to fit inside said provided large bag;
installing an attachment means for removably attaching said small bag approximate to a top of the cavity of said large bag, said attachment means includes:
one or more turns attached directly to the inner wall of said large bag, each of said turns has a rotatable protrusion;
a corresponding number of turn bases positioned to the outside of said small bag, each of said bases has a hole adapted to receive said corresponding rotatable protrusion;
inserting said small bag between the straps and the inner wall of the large bag for preventing said small bag from swinging or flapping inside said large bag;
inserting each of said rotatable protrusions into the corresponding hole in said base; and
rotating said protrusions thereby securing each of said turns to said bases.

16. The method of manufacturing a bag system with a small bag insert of claim 15 wherein said turns are installed approximate to the top of the cavity of said provided large bag and said bases are installed approximate to the top of said provided small bag above an opening;
whereby, when said small bag being secured in said large bag via said turn locks, said turn locks positioning said small bag approximate to the top of said large bag.

* * * * *